US005739788A

United States Patent [19]

Dybdal et al.

[11] Patent Number: 5,739,788

[45] Date of Patent: Apr. 14, 1998

[54] ADAPTIVE RECEIVING ANTENNA FOR BEAM REPOSITIONING

[75] Inventors: Robert B. Dybdal, Palos Verdes Estates; Samuel J. Curry, Redondo Beach, both of Calif.

[73] Assignee: The Aerospace Corporation, El Segundo, Calif.

[21] Appl. No.: 758,709

[22] Filed: Dec. 3, 1996

[51] Int. Cl.[6] ..... H01Q 3/00

[52] U.S. Cl. ..... 342/359; 342/16; 342/75; 455/278.1

[58] Field of Search ..... 342/16, 75, 359; 455/278.1; 343/757

[56] References Cited

U.S. PATENT DOCUMENTS

| | | | |
|---|---|---|---|
| 3,883,872 | 5/1975 | Fletcher et al. | 343/100 PE |
| 4,010,468 | 3/1977 | Fishbein et al. | 343/9.5 |
| 4,707,697 | 11/1987 | Coulter et al. | 342/25 |
| 4,837,576 | 6/1989 | Schwart | 342/77 |
| 4,849,764 | 7/1989 | Van Heyningers | 342/381 |
| 5,317,322 | 5/1994 | Grobert | 342/378 |
| 5,351,060 | 9/1994 | Bayne | 343/766 |

*Primary Examiner*—Thomas H. Tarcza
*Assistant Examiner*—Dao L. Phan
*Attorney, Agent, or Firm*—Derrick Michael Reid

[57] ABSTRACT

An adaptive receiving antenna reduces interference arriving in the main beam of the antenna by redirecting the antenna beam away from the interference source. The receiving antenna projects the main beam to receive desired source signals from a source direction and may receive interfering signals from the interfering source. The antenna system measures the strength of the source signal and interference signal for controlling the direction of the main beam to marginally decrease the received desired source signal while substantially decreasing the received interfering signal to increase the desired source signal to interfering signal ratio so that the desired source signal can be received in the presence of interference.

5 Claims, 3 Drawing Sheets

Open Loop Receive Antenna

Beam Repositioning Technique

Open Loop Receive Antenna

Closed Loop Receive Antenna

ADAPTIVE RECEIVING ANTENNA FOR BEAM REPOSITIONING

STATEMENT OF GOVERNMENT INTEREST

The invention was made with Government support under Contract No. F04701-93-C-0094 by the Department of the Air Force. The Government has certain rights in the invention.

The invention described herein may be manufactured and used by and for the government of the United States for governmental purpose without payment of royalty therefor.

STATEMENT OF RELATED APPLICATION

The present application is related to applicant's copending application entitled Adaptive Transmitting Antenna, U.S. Ser. No. 08/758,710, filed Dec. 3, 1996, by the same inventors.

FIELD OF THE INVENTION

The present invention relates to the field of antenna reception. More particularly, the present invention relates to adaptive techniques for receiving antennas with the purpose of reducing interference.

BACKGROUND OF THE INVENTION

Directional antenna systems increase the received signal to noise ratio, so as to detect a desired signal in the presence of noise. Adaptive receiving antenna systems have also sought to reduce interference, while maintaining a sufficient desired signal level, so as to increase the signal to interference ratio. Directional antenna systems have high gain levels and a narrow conical main beam antenna pattern. One problem with the directional antenna system having adaptive control is the presence of interfering noise arriving within the main beam.

Adaptive antenna systems have been developed to cancel interference. Conventional adaptive technology seeks to maximize the desired signal to interference signal ratio upon reception by changing the antenna pattern. Antenna systems have been used to receive desired signals from a single source in the presence of interference signals from an interfering source dislocated from the signal source such that the desired signal and interference signals arrive at the antenna from differing directions. Adaptive interference cancellation requires detection of interference and must distinguish the desired signal from the interfering signal. Many methods have been used to identify the desired signal from interfering signals, such as the use of a code embedded in the desired signal. Such coded desired signals are widely available and commonly used. After identification of interference and the desired signal, it then is desirable to increase the desired signal to interference signal ratio, so as to enable the detection of the desired signal in the presence of interfering signals. The conventional adaptive designs combine antenna elements to favor reception of desired signals and to produce nulls in the direction of interference. Thus, the overall antenna system pattern is changed to respond to the desired signals and interference signals.

U.S. Pat. No. 3,202,990 to Howells, issued Aug. 24, 1965 entitled Intermediate Frequency Side-Lobe Canceler seeks to cancel interference. Howells discloses techniques for interference cancellation for regions beyond the main beam which are referred to as sidelobes of the antenna pattern. Howells discloses an adaptive antenna system design combining a primary radar antenna with an auxiliary omni directional antenna. The radar transmits a signal and detects the return signal, and by the direction and time delay, determines the location of a source. The auxiliary omni directional antenna is used to cancel sidelobe interference of the primary radar antenna. One problem with the Howells sidelobe canceler design is that it does not seek to reduce interference that arrives in the main beam of the radar. Another problem is the cost of a plurality of antenna elements to provide cancellation, adaptive weighing circuitry and equalization circuitry for wide bandwidth signals. Still another problem is the duplicative required channel processing and circuitry for such plurality of antenna elements.

Radar tracking systems and communication tracking systems have used weighted adaptive techniques to change the receiver antenna pattern to acquire the desired signal and minimize interference arriving within the main beam. Also, phased array radars and directional antennas also produce a directional main beam that changes direction when tracking a single source or tracking a target. Such systems track a source by pointing the main beam directly at the single source or target. Such systems disadvantageously require circuit and methods which alter the main beam antenna pattern and disadvantageously require duplicative or complex circuitry. Such system also disadvantageously point the main beam at the target or signal source without regard to interference signals which may enter the main beam. These and other disadvantages are solved or reduced using the present invention.

SUMMARY OF THE INVENTION

An object of this invention is to provide an antenna main beam which detects a desired signal in the presence of a interference signal entering the main beam.

Another object of this invention is to provide a cost effective antenna system that reduces the effects of main beam interference.

Yet another object of the present invention is to reposition an antenna main beam offset from a signal source in a direction away from the interference to marginally decrease the desired signal while significantly reducing main beam interference.

Still another object of the present invention is to reposition an antenna main beam offset from the direction of a signal source in a direction away from the interference source to marginally decrease reception of the desired signal while significantly reducing main beam interference reception so as to increase the ratio of the desired signal to the interference signal.

Yet a further object of the present invention is to reposition under closed loop control an antenna main beam offset from the desired signal source in a direction away from the interference source to marginally decrease reception of the desired signal while significantly reducing reception of main beam interference to maximize the desired signal to interference signal ratio.

An adaptive receive antenna projects a main beam in an off source direction to maximize the desired signal to interference ratio, so as to be able to detect the desired signal in the presence of an interfering signal. By projecting the main beam off the desired source, there is a marginal decrease in the desired signal with a substantial decrease in the interfering signal such that the desired signal can still be detected in the presence of large interfering signals.

The adaptive antenna beam pointing technique changes the main beam direction to maximize the desired signal to interference ratio, which may be at the expense of the desired signal to noise ratio, in order to receive the desired signal in the presence of interference. The system maximizes the desired signal to interference ratio while reducing the desired signal to noise ratio, yet still maintaining acceptable desired signal reception.

The desired signal and interfering signals are assumed to have different directions of arrival which is common to all antenna interference reduction techniques. The adaptive receiving antenna receives sufficient desired signal to receive the desired signal when the main beam is repositioned. The adaptive antenna beam pointing uses an embedded signal, preferably a code, to detect the desired signal in the presence of the interfering signal. The preferred code is known to both the adaptive receiving antenna and the desired signal source transmitter to identify the desired signal.

The adaptive antenna beam pointing does not require modification of the antenna pattern, and is therefore applicable to a wide variety of conventional receiving antenna systems reducing design complexity. Additional antenna elements used by conventional adaptive antennas, RF electronics, weighing circuitry, summing networks guided by correlation products and power measurements can be replaced with less complex control electronics to reposition the antenna. The adaptive antenna beam pointing is applicable to wide bandwidth signals.

The adaptive receiving antenna may be used in either open or closed loop tracking systems to maintain beam pointing with or without the presence of the interfering signal. The adaptive receiving antenna may also be used with other interfering reduction techniques such as conventional sidelobe cancellation techniques. These and other advantages will become more apparent from the following detailed description of the preferred embodiment.

DETAILED DESCRIPTION OF THE PREFERRED EMBODIMENT

Figure 1:
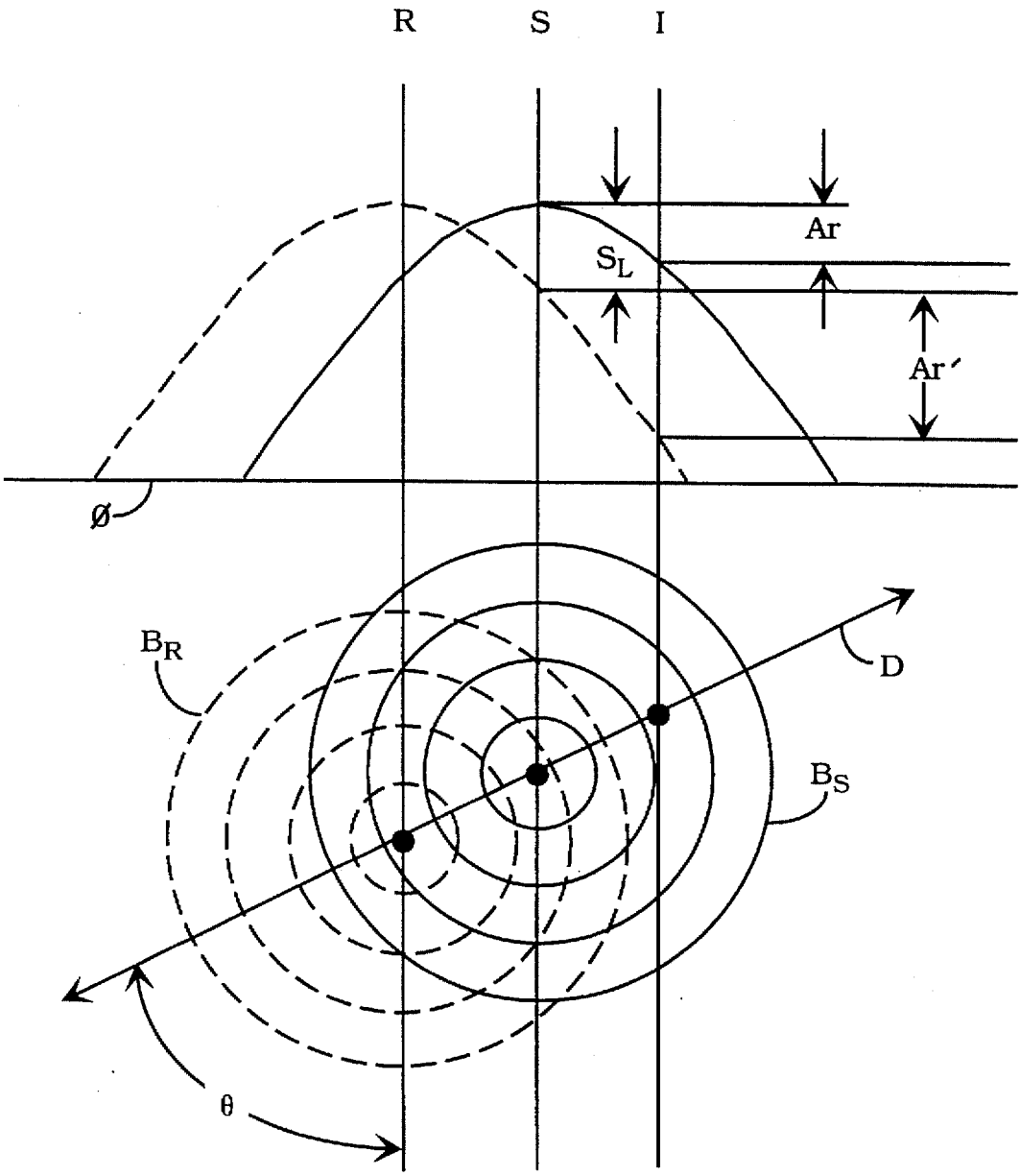
FIG. 1 is a diagram representing a beam repositioning technique of a receiving antenna.

An embodiment of the present invention is described with reference to the figures using reference designations as shown in the figures. Referring to FIG. 1, the adaptive receiving antenna pattern is depicted in both its contour form in two angular directions $\phi$ and $\theta$ as a pattern taken through a plane containing the desired signal S and the interference source I. The main beam pattern has a peak gain level at its center. Beyond this main beam region are sidelobes, not shown, whose maxima are substantially weaker than the main beam. The location of the peak gain level is commonly defined by an axis in two angular coordinates describing the pattern, or gain variation of the antenna with angular change. This axis is referred to as the boresight axis because it contains the maximum pattern gain level at a maximum receiving sensitivity. The main beam pattern is defined by a gain profile as a function of angular displacements, $\phi$ and $\theta$. The main beam gain profile is approximated by Gaussian curve for a typical circular reflector antenna, as shown, having a typical conical beam pattern with the gain of the antenna pattern in the boresight direction at a maxima normalized to unity gain. As the direction towards the desired signal source is angularly displaced from the boresight line of sight, the effective antenna gain decreases from unity gain.

When interference is not present, the boresight axis BS is aligned with the desired signal S. In this way, the peak gain of the antenna is coincident with a line of sight towards the desired signal source so that maximum signal power of the desired signal is received. The alignment of the boresight axis BS with line of sight towards the desired signal source may be accomplished by several well understood methods. In some cases, knowledge of the location of desired signal source may be adequate to align the boresight axis BS with the desired signal source S. This technique is commonly referred to as open loop pointing. In other cases, where the location of the desired signal source S is not known with sufficient accuracy, antenna positioning techniques referred to as tracking are employed to align the boresight axis BS with the desired single source S. Tracking techniques are closed loop pointing methods are also well understood. Without interference, maximum receiving performance is achieved when the antenna boresight BS is aligned with the line of sight towards the desired signal source S and the maximum signal to noise ratio is achieved.

When interference is present, the performance of the receiving system is degraded. The amount of degradation depends on the level of the interference and the spectra of both the interference and desired signal. The effects of interference are quantified by determining a desired signal to interference ratio which indicates the relative amount of power between the desired signal and interference signal. An increased desired signal to interference ratio improves the reception of the desired signal. Acceptable system performance depends jointly on the desired signal to interference ratio and the desired signal to noise ratio. When repositioning the boresight to BR away from the line of sight BS towards the desired single source in direction D to maximize the desired signal to interference ratio, the desired signal to noise ratio must be maintained at an acceptable level to adequately receive the desired signal.

The system maintains normal antenna pointing with the boresight axis BS aligned towards the desired signal source until the presence of interference signal is detected from an interference source I. The line of sight towards the interference source I is presumed to be different than the line of sight towards the desired signal source S. When the presence of interference is detected, the antenna boresight is repositioned from its original alignment BS towards desired signal source to a new position BR in a direction R away from the interference source I. At the original boresight alignment towards the desired signal source, the interference signal is received at a lower gain level than the desired signal source signal because the interference and desired signal level are not spatially collocated along the same line of sight. The desired signal to interference ratio depends on both the power densities of the incident desired signal and interference signal and the difference in the antenna gain levels for the desired signal and interference signal directions. This difference in the antenna gain levels will be referred to as the antenna rejection Ar.

The antenna pattern is repositioned to boresight BR towards R and away from the interference I. When the antenna alignment S is changed to R at the repositioned boresight alignment BR away from the interference source I, the antenna rejection Ar increases to Ar'. The amount of antenna rejection Ar at the original boresight BS aligned towards the desired signal source S is less than the antenna rejection Ar' when the repositioned boresight BR is aligned R away from the interference source I. The desired signal to interference ratio is increased by repositioning the beam from S to R because the antenna rejection increases from Ar to Ar'. However, the repositioning from S to R results in a reduction in the desired signal power because the desired signal now arrives at an angle removed from the antenna boresight maxima at the highest gain value. This desired signal level reduction SL causes a reduction in the desired signal to noise ratio.

A minimum desired signal to noise ratio threshold exists corresponding to acceptable system performance. In operation, the minimum desired signal to noise threshold level is typically exceeded to maintain acceptable performance during variations in link performance resulting from component variations, propagation loss variations, and other factors. The amount that the system exceeds the minimum threshold level is referred to as a signal margin. The antenna beam may be repositioned away from the desired signal source by an amount corresponding to the available signal margin. The desired signal is received when the system operates at or above the desired signal to noise ratio threshold level. The desired signal to interference signal ratio after beam repositioning from S to R has been increased over the desired signal to interference signal ratio when the antenna boresight BS was aligned towards the desired signal source S. Thus, the beam repositioning from S to R increases the desired signal to interference ratio while maintaining the signal to noise ratio at or above the required desired signal to noise ratio threshold level.

The beam may be repositioned so that the interference is aligned with the null that exists between the main antenna beam and the sidelobes. Such a situation may be practical when the interference is located near the edge of the beam. But when the line of sight towards the interference signal is near the line of sight towards the desired signal source, the signal loss SL may be excessive. As is the case in all techniques for interference protection, limits exist on the amount of interference rejection reduction Ar that can be achieved while maintaining the desired signal to noise ratio above the threshold level.

The beam repositioning can be implemented in a variety of ways, and two exemplar embodiments will be described. The first embodiment is for an open loop pointing design shown in FIG. 2 and the second is for a closed loop tracking design shown in FIG. 3. Independent of the implementation, a means must exist to distinguish interference from the desired signal, a feature common to all adaptive designs. Adaptive repositioning of the main beam for interference suppression requires an ability to detect the desired source signal S in the presence of the interfering signal I.

In the exemplar embodiments, signal coding techniques are preferably used to identify the desired signals. A code is embedded in the desired signal and this code is also known to the receiving system where beam repositioning is applied. A variety of such codes exist, for example, hopping the carrier frequency in a random sequence or a pseudo-random bit stream. Such techniques are commonly used in spread spectrum systems. Spread spectrum systems use a modulation technique to reduce interference effects. Spread spectrum modulation is used for both interference reduction and identifying the desired signal for antenna beam repositioning. The coded signal is assumed to be unknown by the interference source, and the code and its sequence is not present in the interference signal. Such codes are commonly used in code division multiple access spread spectrum modulation systems. The embedded code is modulated into a user signal to create the desired signal. Identification of the coded desired signal from the interfering signal enables adaptive control to reposition the main beam. Open loop and closed loop control are preferred methods of repositioning the main beam.

Figure 2:
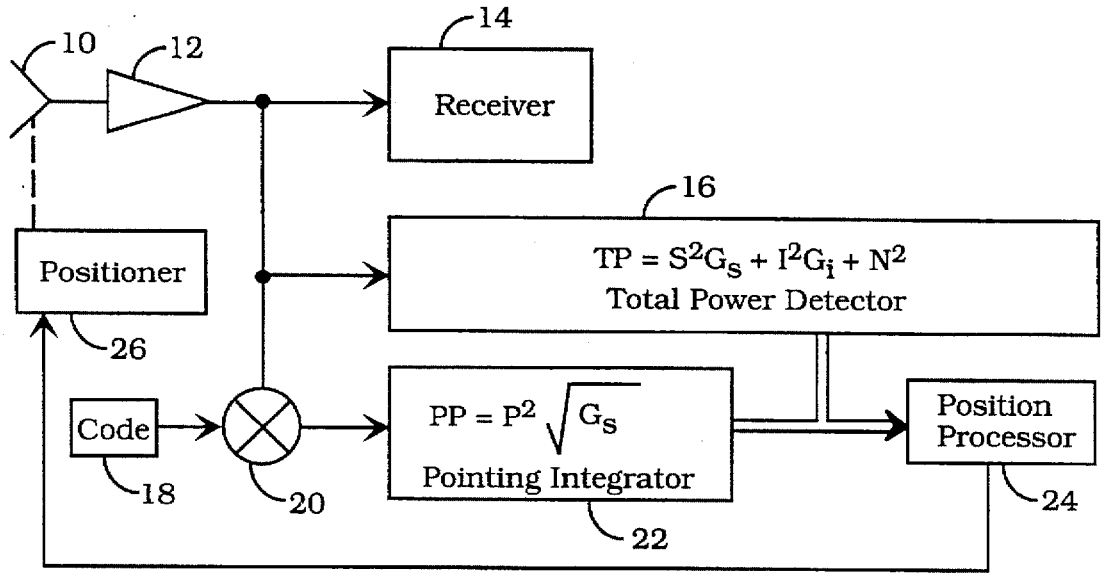
FIG. 2 is a block diagram of an open loop receiving antenna.

Referring to FIG. 2, an open loop receive antenna system includes an antenna 10, preamplification 12, and a receiver 14 which demodulates the coded desired signal. The antenna 10 may be a typical circular reflector antenna for receiving modulated source signals from a transmitter, not shown. The receiver 14 may be a conventional receiver such as a Microdyne digital receiver with digital bit synchronizer, carrier tracking loop and spread spectrum demodulation. The function of the receiver 14 is to demodulate the received signal. CDMA spread spectrum modulation is preferably used, though other modulation methods may be used as well. The transmitter is used to broadcast the modulated coded source signal typically over a given coverage area covering a plurality of users assigned respective codes within the CDMA modulation scheme. The source signal comprises one or more superimposed desired signals modulated by respectively assigned codes. The transmitter typically continuously broadcasts the source signal at a given constant down link total power level. An embedded wideband code spreads the bandwidth of the source signal as a modulation method, and the wide band code is known to both the transmitter and receiver 14. An embedded code determines spectrum spread modulation and identifies a respective desired signal.

The antenna 10 receives various signals including the source signal S comprising many coded desired signals, one of which is the desired signal with an embedded code referred to as the pointing signal P to be received. The antenna 10 also collects the interfering signal I. The preamplifier 12 amplifies the source signal S and interfering signal I as well as establishing a noise signal N which is present in any system. The source signal S is preamplified 12 and delivered to the receiver 14 for demodulation. The preamplifier 14 is preferably a low noise preamplifier. The adaptive technique is embodied in a power detector 16, code generator 18, a mixer 20, an integrator 22, position processor 24 and positioned 26. The receiver 14 performs frequency conversion, desired signal acquisition, and demodulation of the desired signal. In spread spectrum modulation, the source signal is a composite signal having several superimposed desired signals modulated by respective codes. A component of the source signals is the pointing signal P comprising the embedded code signal and the desired signal.

The open loop antenna system detects the total input power received by the antenna 10 by the total power detector 16, reproduces the code by the code generator 18, cross correlates the source signal S using the mixer 20 and pointing integrator 22 for detecting the presence of the desired signal of the coded pointing signal P. The cross correlation elements 20 and 22 and the total power detector 16 are used to detect the desired pointing power PP separated from the total power TP that also include interference I and noise N components. In many systems, the total power TP is detected 16 for monitoring link quality and diagnostic purposes. The positioned 26 positions the antenna 10 in response to commands from the position processor 24.

The processor 24 receive total power signal TP from the power detector 16 where S is the source power, Gs is the antenna gain in the direction of the source signal, I is the power of the interfering signal, Gi is the antenna gain in the direction of the interfering signal and N is the power of noise. The mixer 20 and integrator 22 provide a cross-correlated pointing signal PP. P is the power of the pointing signal. The processor 24 analyzes the TP and PP power levels and generates angular coordinates which are communicated to a positioner 26 which repositions the antenna 10 to those angular coordinates. The positioner 26 may be a two axis gimbal positioner.

When interference is not present, the position processor 24 computes the angular location of the desired signal source relative to the current position of antenna and commands the positioner 26 to point the antenna boresight in alignment towards the desired signal source. The open loop control system enables open loop positioning to determine the direction of the source signal in the absence of interference. One such open loop positioning technique is the step positioning method. Step positioning alternately measures the pointing signal P at two angular step positions equally and oppositely displaced from a nominal pointing position at the source signal. When an antenna is directed towards the source signal S, both alternate measurements of the power level of the receive signal will be the same. The alternative measurements may be continuously monitored requiring continuous dithering of the antenna position during open loop positioning. When the two power level are not the same, the open loop system can compute a new nominal position and adjust the antenna to the new nominal position. The step position process is the same for both angular coordinates of a conventional two gimbal positioner 26.

The received signal including the source signal S is correlated to the code, using the mixer 20 and integrator 22. A coded signal 18 is generated identifying the coded pointing signal P within the composite source signal S. The open loop adaptive antenna system cross correlates the received source signal from the amplifier 12 with a replica of the pointing signal P provided by the code generator 18. The relative proportions of the source signal S and pointing signal P are predetermined. A ratio of the total power TP and the coded power signal PP can be measured and compared with the predetermined value. If the measured value differs from the predetermined value, then the presence of an interfering signal is detected.

When interference initiates, its presence is indicated in the total power detector 16. The total power detector 16 measures the sum of the signal power, the interference power, and the unavoidable noise power. For communication applications, the noise power and signal power remains at a relatively fixed level, so that when interference is initiated, its presence is clearly indicated by a level change in the power detector TP. The TP/PP power ratio of the total signal power and the pointing signal power is continuously monitored when positioning the antenna towards the desired signal source to indicate the presence or initiation of the interfering signal. The pointing signal P does not correlate to the interfering signal I so that beam positioning adjustments are made in the presence of the interfering signal. A communication system typically has a minimum bit error rate requirement. The system can be calibrated in the absence of interference and in the presence of noise to determine the minimum PP value to sustain an acceptable error rate within a given signal to noise ratio P/N. The available pointing signal margin is the difference between the measured pointing signal power PP and the PP minimum value. The antenna can be repositioned so long as there remains a signal margin, that is when PP is greater than the PP minimum value. An indication of the received signal level is provided by integrator 22. The coded desired signal is correlated with a replica of the code 18. The code is not correlated with the system noise or the interference signal. Thus, the output of the correlator 22 responds only to the desired signal containing the code and provides a response that is proportional to the received desired signal level. The correlation level at the output of the integrator 22 can be calibrated to establish a level corresponding to the threshold signal power for acceptable system performance. The difference between actual correlation level measured at a given time and the threshold level is the signal margin. In this way, the available signal margin can be determined.

When interference is detected, then the antenna positioner 26 can be commanded to reposition from its current pointing alignment in the direction of the source signal away from the source of interference. When interference has been detected, the antenna can be repositioned with the desired signal to noise ratio within an available signal margin. Several open loop repositioning methods may be used to reposition the antenna in the presence of interference. One repositioning method is the angular offset method. An angular offset corresponding to the available signal margins of the received pointing signal is used to step reposition the antenna away from the desired source signal. The antenna is offset from the original boresight alignment with the desired signal source by an amount corresponding to the available signal margin. The antenna is then controlled to be rotated around the original desired signal source while maintaining the angular offset at a constant value. By monitoring the TP/PP power ratio during angular offset rotation about the source signal direction and stopping the antenna rotation when the TP/PP power ratio is at a minimum value, the antenna will be positioned at a location away from the direction of the interfering signal. When the pointing signal P is not within acceptable margin, that is, PP is less than a PP minimum value, the angular offset can be reduced by angular steps followed by respective rotations to hunt for a position in which the pointing signal can be received, that is, PP is greater than the PP minimum value yet with reduced interference. After an angular offset, the antenna is rotated about the original boresight alignment with the desired signal. The correlator output 22 measuring the received desired signal level should not vary with rotation. The correlator output PP also indicates the threshold signal level. The total power detector 16 will vary with rotation indicating a maximum value when the position is closest to the interference and the desired minimum value when farthest from the interference. At this point, the interference is minimized subject to the constraint of maintaining the threshold level of the desired signal to noise ratio. Alternative methods for repositioning the antenna could be used as well, For example, a spiral repositioning method using increasing steps and angular displacements can be used for repositioning the beam away from the source of interference.

Figure 3:
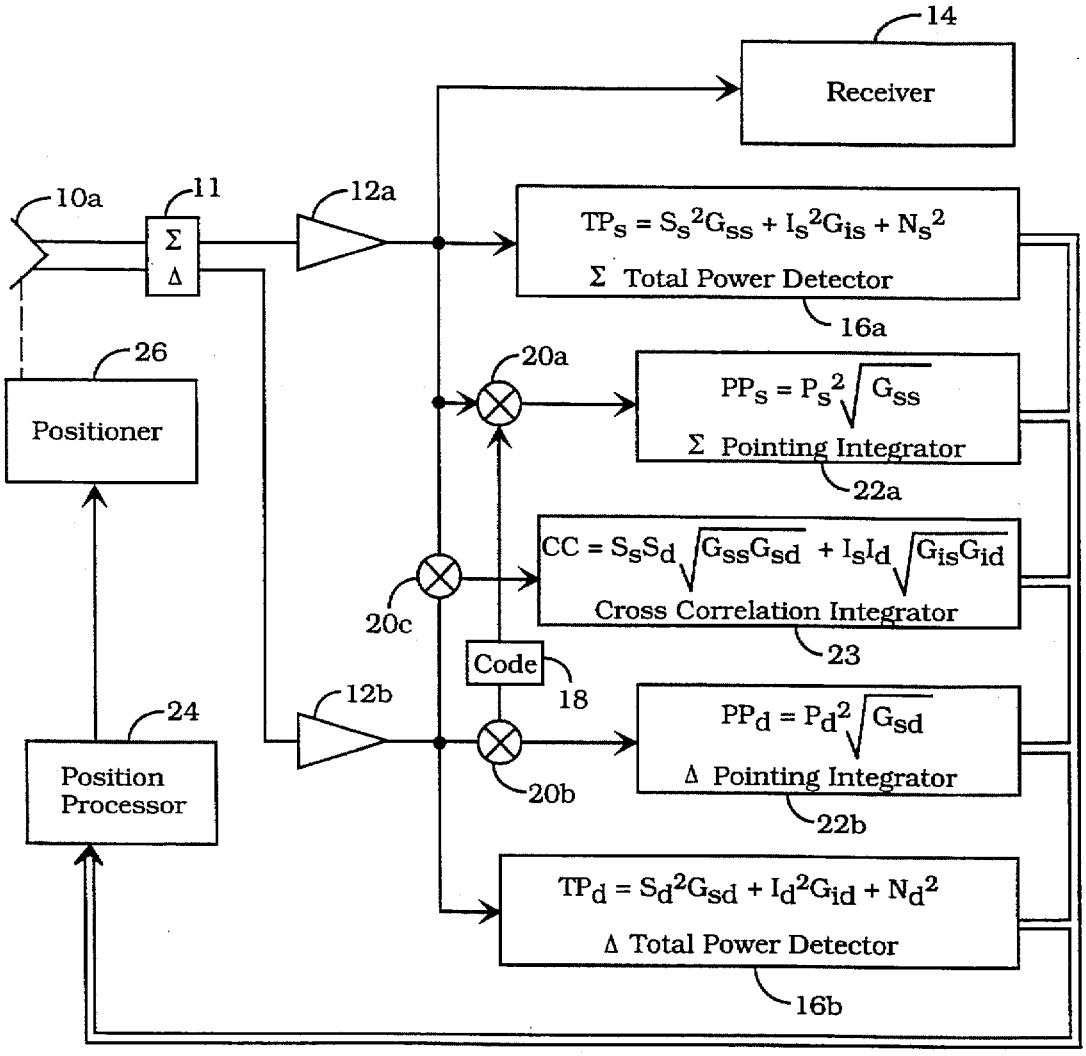
FIG. 3 is a block diagram of a closed loop receiving antenna.

Referring to FIG. 3, a closed loop antenna system includes a conventional quadrature antenna 10*a* having two sets of dual feeds, each having respective positive gain profiles angularly offset from a center boresight position. Each orthogonal plane has two opposing feed signals. The two feed signals are communicated through a conventional a hybrid 11 providing a sum signal and a difference signal. The sum signal is the sum of the two feed gain profiles and is characterized by a large gain profile at the center position. The difference signal is the difference between the two feed gain profiles and is characterized by a null at the center position with a positive gain profile and negative gain profile angular displaced on respective sides of the center null position, as is well known.

The hybrid 11 provide a sum signal, to an amplifier 12*a* communicating the sum signal Ss and a sum noise signal Ns to a sum channel power detector 16*a*, a sum mixer 20*a* and a cross correlation mixer 20*c*, and provides a difference signal to an amplifier 12*b* communicating the difference signal Sd and a difference noise signal Nd to a sum channel power detector 16*b*, a sum mixer 20*b* and the cross correlation mixer 20*c*. The sum channel power detector 16*a* provides for a sum channel total power signal TPs. The difference power detector 16*b* provides for a difference channel total power signal TPd. The sum mixer 20*a* and sum integrator 22*a* provide a sum channel pointing power signal PPs. The difference mixer 20*b* and difference integrator 22*b* provide a difference channel pointing power signal PPd. The cross correlation mixer 20*c* and cross correlation integrator 23 provide a cross correlation power signal CC.

The received signal level is monitored with power detectors 16*a* and 16*b* and correlated with the coded signal indicated by the mixers 20*a* and 20*b* and the integrators 22*a* and 22*b*. The operations are performed for both the sum and difference channels. In addition, the sum and difference channels are cross correlated by the mixer 20*c* and the cross correlation integrator 23. This cross correlation provides additional information to be used in determining the initiation of interference and monitoring the reduction of interference power during antenna beam repositioning. The measured signal quantities depend on the antenna gain values. Ss is the power of the sum channel source signal. Gss is sum channel gain in the direction of the source transmitter. Is is the power of sum channel interference signal. Gis is the sum channel gain in the direction of the interference. Ns is the power of sum channel noise signal. Sd is the power of the difference channel source signal. Gsd is difference channel gain in the direction of the source transmitter. Id is the power of the difference channel interference signal. Gid is the difference channel gain in the direction of the interference. Nd is the power of difference channel noise signal.

Closed loop systems for antenna pointing are preferably used in applications where the knowledge of the desired signal location lacks the accuracy required for open loop pointing and occurs when the antenna beamwidth is an appreciable fraction of the uncertainty in pointing direction. In operation, the antenna 10*a* provides a sum and a difference beam to perform the pointing alignment. Closed loop tracking is referred to as monopulse processing. In practice, the sum beam has a maximum value on the boresight axis. The sum beam is preamplified and routed to the receiver 14 for demodulation. The difference beam contains a minima on the boresight axis. By measuring and maximizing the ratio of the sum and difference channel powers TPs and TPd, the alignment of the antenna boresight with the desired signal is accomplished in the absence of interference. The closed loop system maintains alignment pointing towards the desired signal by periodically sampling the sum and difference beams. A conventional means of producing the sum and difference beams is with a multiple horn feed system in the focal region, where the horns are combined in a hybrid network 11. In this case, the sum beam consists of the sum of the horns and the difference beam consists of the subtraction of the horns to form a null on the boresight axis. A variety of different implementations, e.g., multiple horn feeds, multimode feed designs, etc exist to generate the sum and difference beams.

The source signal S is received by the antenna 10*a* and sum and difference source signals Ss and Sd are communicated through the hybrid 11. The sum source signal Ss is preamplified 12*a* and routed to the receiver 14 for demodulation. The source signal S is also routed to the sum total power detector 16*a* providing the TPs output. The sum source signal is also correlated with a replica of the code 18 to provide the sum desired signal pointing power PPs level unobscured by either system noise or interference. The correlated output PPs for the sum channel 22*a* can be calibrated to establish a threshold level for acceptable system operation and the measured output at any given time can be used to determine the available signal margin. The difference source signal Sd is amplified by preamplifier 12*b* and communicated to the difference power detector 16*b* providing the difference total power signal TPd. The difference source signal Ssd is correlated with a replica of the code 18 to provide the difference desired pointing power signal PPd. When interference is absent, the position processor 24 monitors TPs, PPs, TPd and PPd to determine whether the antenna boresight is aligned with the desired signal source and the amount to reposition the antenna using the positioner 26 to align the antenna towards the desired signal source. The ratio of the sum and difference channel pointing integrators 22*a* and 22*b* determine the displacement of the antenna boresight from the desired signal and the sign of this ratio describes the direction of the displacement. Specifically, the ratio of 22*a* to 22*b* relates to the angular displacement and directions of the main beam in both planes to track source signal transmitter. Typically, this ratio PPs/PPd is monitored and minimized to track the desired signal. When the total power ratio is above a predetermined tracking value, the antenna is considered to be tracking the source signal. During tracking, the main beam is positioned in the direction of the source and PPs is at a maximum value when Gss is at a maximum, and PPd is at a minimum value when Gsd is at the null value. When the total power ratio is above the predetermined tracking value, the magnitude and sign of the total power ratio is used to reposition the antenna to track the signal source. The sign of the ratio varies between opposite sides of the main beam axis to determine which direction to reposition the antenna. The ratio PPd/PPs indicates the direction of the reposition due to the positive and negative gain profiles on respective sides of the null center position of the difference channel. Thus, tracking of the source can be accomplished without dithering of the main beam. When the ratio is above the tracking value, a threshold level, realignment to the source is necessary. The magnitudes of PPs/PPd ratio can be initially calibrated to angular displacements in a look-up table as a tracking map, such that, the processor 24 may use the tracking map table to store calibration data to cross reference the total power ratio to the angular displacements, for realignment in both orthogonal planes. The processor 24 adds the angular displacements respectively to the current angular position to generate the new tracking coordinates for both planes. The correlation used to obtain PPs 22*a*, and PPd 22*b* results in antenna tracking that is insensitive to interference Interference is indicated by the total power detectors 16*a* and 16*b* and also by the cross correlation integrator 23. Each of these detectors 16*a* and 16*b* have different sensitivity characteristics, and one or both may be used to detect the presence of interference. The two total power detectors 16*a* and 16*b* contain an interference component Is and Id, respectively, and thereby provide an indication of the presence of interference. The cross correlation integrator output 23 also provides an indication of interference. The correlation process removes the noise components because the sum and difference channel noise components are uncorrelated. Like the power detector 16*a* and 16*b*, the source power S has a relatively constant power when the beam is aligned to the source. When interference is initiated, the TPs, TPd and CC output indicate the presence of interference.

The selection of the interference indicators, TPs, TPd or CC and use depends on the system applications and specifics. Some system may have desired signal level variations that can be misinterpreted as interference, e.g., EHF systems operating above 30 GHz experience propagation losses that vary with rainfall rates. In this case, the CC output of the cross correlation integrator 23 divided by the product of the sum 22*a* and difference 22*b* pointing integrators, PPs×PPd, yields an output that is independent of the desired signal level so that interference initiation is clearly indicated by changes in the CC output. In still other applications where spread spectrum modulation techniques are used to provide additional interference protection, the desired signal component in the receive bandwidth may have a smaller value than the noise level, and in these applications, additional signal processing referred to as despreading is used to achieve a usable, processed signal to noise ratio. In this spread spectrum application, antenna repositioning may not be desirable for lower level interference that is adequately protected by spread spectrum modulation. In spread spectrum applications, interference that is sufficiently strong to require the additional protection afforded by antenna beam repositioning is indicated when the interference level exceeds the noise level in the RF bandwidth as indicated by the total power detector 16*a*. Various interference detection methods provide various tradeoffs for specific applications.

The cross correlation power signal CC is preferably used to determine the presence of interference. The cross correlation power signal between the sum and difference signal provide increased sensitivity to the presence of interference than the total power signal TPs or TPd. In spread spectrum modulation applications, the source power is often lower than the noise power in the input bandwidth. The mixer 20*c* and integrator 23 provide cross correlation of coherent signals. The sum source signal Ss and difference source Sd are coherent and cross correlate, and the sum interference signal Is and difference interference signal Id are also coherent and also cross correlate, but the sum noise signal Ns and the difference noise signal Nd are not coherent and therefore do not cross correlate, so that, the cross correlation output is dependent on the Ss, Sd, Is, Id, but not Ns and Nd. The total power signals TIPs and TPd have noise components, whereas the cross correlation power signal CC has no noise signal component, so the cross correlation power signal is preferably used to determine the presence of interference in noisy systems. When tracking the source signal with the main beam directed towards the source, the Gsd gain value is at the null value, such that, the source signal component of CC value is zero thereby providing a sensitive indication of the presence of interference. In the presence of interference, cross-correlation is dominated by interference because the antenna is pointed at the null of the difference pattern, so that, Gsd is a zero, and the SsSd term is zero. The cross-correlation value may be calibrated to an interference threshold value CCi, such that, when the cross-correlation power signal CC is greater than the cross-correlation interference threshold, that is CC>CCi, interference is considered significant, such that, modulation protection may not be sufficient thereby requiring adaptive antenna repositioning.

Typically, the source signal power transmission level does not vary over the life of the source transmitter. In the case where the receive source signal may vary, such as during rain conditions within an EHF link, where the link is dependent upon dynamic environmental changes, the cross-correlation power signal CC may vary, which may falsely indicate the present of interference, and render CC calibration ineffective. An environmentally insensitive cross correlation ratio can be used to indicate interference. The cross correlation ratio is equal to the square of cross-correlation power signal CC divided by the product of the pointing power signal PPs and PPd. This quotient is insensitive to link performance and source signal variation, because the source signal and the coded component P wary equally. When interference is absent, the cross-correlation ratio is equal to a fixed value and is insensitive to link performance. This cross-correlation ratio value can be calibrated to a predetermined cross-correlation ratio threshold value and used to indicate the initiation of significant interference.

When interference initiates, a variety of methods may be employed to reposition the beam away from the interference. An angular step method may be used with the added benefit of monitoring the interference reduction from the power detectors 16*a* and 16*b* and cross correlation output CC. A map estimation method estimates the interference location from the sum and difference power levels of the detectors 16*a* and 16*b*. The desired pointing signals PPs and PPd are known in both channels, and the sum and difference total power ratio TPs/TPd for the interference components Is and Id can be determined. Knowing the sum and difference variations of the antenna pattern through calibration, the measured total power ratio can be compared with stored values in the processor 24 to estimate the interference direction. Knowing the interference direction, the antenna can be repositioned away from the interference to the extent provided by the signal margin indicated by the sum channel correlation 22*a* compared to a calibrated signal threshold level that defines the signal margin.

Another antenna map method moves the antenna beam to minimize the interference component in the cross correlation output CC of integrator 23. The variation in the signal power component PPs or PPd in the output of the integrators 22*a* and 22*b* at a given time can be measured and compared to angular variation of the antenna pattern known from calibration. An antenna map can be constructed using known antenna sum and difference patterns so that the signal component variation of PPs and PPd with beam repositioning can be determined and subtracted from the cross correlation integrator 23 to isolate the variation in the interference component. Variations of the interference components Is and Id over beam repositioning determine the direction towards the interference. The interference term in the cross correlation integrator 23 depends on the difference pattern gain level which is minimized when the antenna boresight is aligned with the interference. Knowing the interference location and the available signal margin from 22*a*, the position processor 24 can command the antenna to reposition itself away from the interference while maintaining an acceptable signal level which can be validated by comparing the sum channel integrator output 22*a* with a threshold level for acceptable signal reception. These examples illustrate alternative means for using the measured information in the processor 24 to achieve the goal of repositioning the antenna to maintain the minimum acceptable signal level while maximizing the desired signal to interference ratio. The preferred close loop embodiment detects interference initiation by three distinct indications, the power detectors 16*a* and 16*b* and the cross correlation CC of integrator 23. The desired signal is measured by the sum and difference correlations 22*a* and 22*b*. The desired signal level relative to threshold value for acceptable operation can be determined by calibration.

The present invention employs beam alignment rather than altering the beam pattern and can be applied to many antenna systems. Multiplicity of antenna elements, adaptive weighing circuitry and combiners, and adaptive equalization is not required. This invention reduces main beam interference, and thus complements existing sidelobe cancelers that do not cancel main beam interference. A significant advantage of this system is that unlike conventional adaptive antenna designs, adaptive equalization is not required to reduce interference for wide bandwidth signal reception. The exemplar embodiments may be modified and enhanced. Those modification or enhancement may fall within the spirit and scope of the following claims.

What is claimed is:

1. A method for adaptively receiving a desired signal in the presence of an interfering signal both arriving within an antenna beam, the method comprising the steps of, pointing the antenna beam in a source direction to receive the desired signal in the presence of noise, the desired signal and noise have a desired signal to noise ratio above a threshold level, detecting the presence of the interference signal from an interference direction, the desired signal and interference signal have a desired signal to interference signal ratio, and repositioning the antenna beam in a direction away from the source direction and away from interference direction to increase the desired signal to interference signal ratio while maintaining desired signal to noise ratio above the threshold level.

2. The method of claim one wherein the desired signal is characterized by an embedded code, said method further comprises the steps of, providing a total power output of the desired signal, interference signal and noise signal when pointing the antenna beam in the source direction, and providing a desired signal output by the presence of the embedded code.

3. A method for adaptive receiving a source signal from a source direction in the presence of an interfering signal both arriving within an antenna beam, the source signal comprises a desired signal having an embedded code, the method comprising the steps of, pointing the antenna beam in source direction to receive the source signal received in the presence of noise, providing a total power output of the source signal, interference signal and noise signal when pointing the antenna beam in the source direction, generating a generated code identical to the embedded code, providing a desired signal output by cross correlation of the generated code and source signal, the desired signal and noise have a desired signal to noise ratio above a threshold level, detecting the presence of the interference signal from an interference direction, the desired signal and interference signal have a desired signal to interference signal ratio, and repositioning the antenna beam in a direction away from the source direction and away from interference direction to increase the desired signal to interference signal ratio while maintaining desired signal to noise ratio above the threshold level.

4. A method of claim 3 wherein a source signal comprises a plurality of desired signals and respective embedded codes, one of said plurality of desired signals is the desired signal and one of said respective embedded codes is the embedded code.

5. The method of claim 3 wherein said antenna beam is defined by two orthogonal planes, said providing said total power output step is executed for each orthogonal plane.

* * * * *